US005488222A

United States Patent [19]

Gault et al.

[11] Patent Number: 5,488,222

[45] Date of Patent: Jan. 30, 1996

[54] ELECTRODE ARRANGEMENT FOR CREATING CORONA AND METHOD OF TREATING ELECTRICALLY-CONDUCTIVE SURFACES

[76] Inventors: Michael J. Gault, 4618 Compass Rose, #21, Vermilion, Ohio 44089; Ernest H. Pfaff, 1549 Woodvale Ave., Deerfield, Ill. 60015

[21] Appl. No.: 307,198

[22] Filed: Sep. 16, 1994

[51] Int. Cl.[6] ..... H01T 19/00

[52] U.S. Cl. ..... 250/324; 361/225

[58] Field of Search ..... 250/324, 325, 250/326; 313/243; 361/225, 231, 232

[56] References Cited

U.S. PATENT DOCUMENTS

| | | | |
|---|---|---|---|
| 3,873,835 | 3/1975 | Ignatjev | 250/324 |
| 4,363,072 | 12/1982 | Coggins | 250/324 |
| 5,019,709 | 5/1991 | Pfaff | 250/324 |
| 5,116,583 | 5/1992 | Batchelder et al. | 250/324 |

*Primary Examiner*—Jack J. Berman

*Attorney, Agent, or Firm*—Lee, Mann, Smith, McWilliams, Sweeney & Ohlson

[57] ABSTRACT

An electrode arrangement for creation of corona over an area, and for treating electrically-conductive surfaces which might otherwise experience arcing from the electrode arrangement to the surface. The arrangement includes an electrode, and an electrically insulative shroud for the electrode. A source of nitrogen gas is provided for creating a non-arcing atmosphere. The electrode is stationary or rotatable with the shroud.

20 Claims, 2 Drawing Sheets

Fig. 3
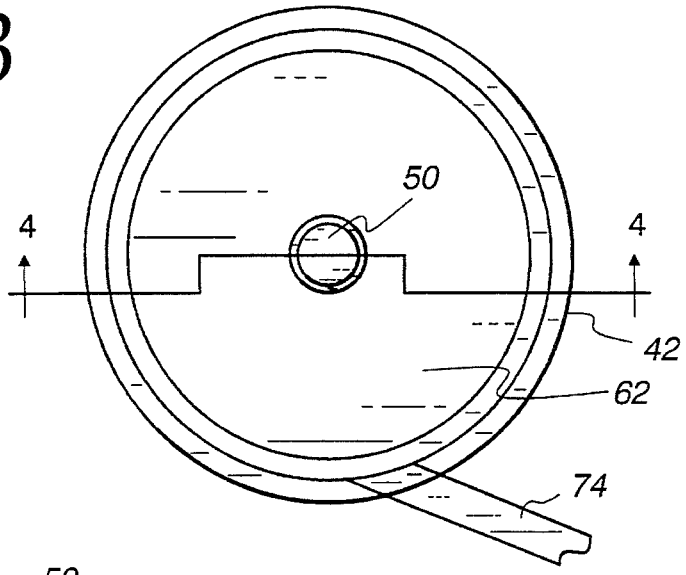
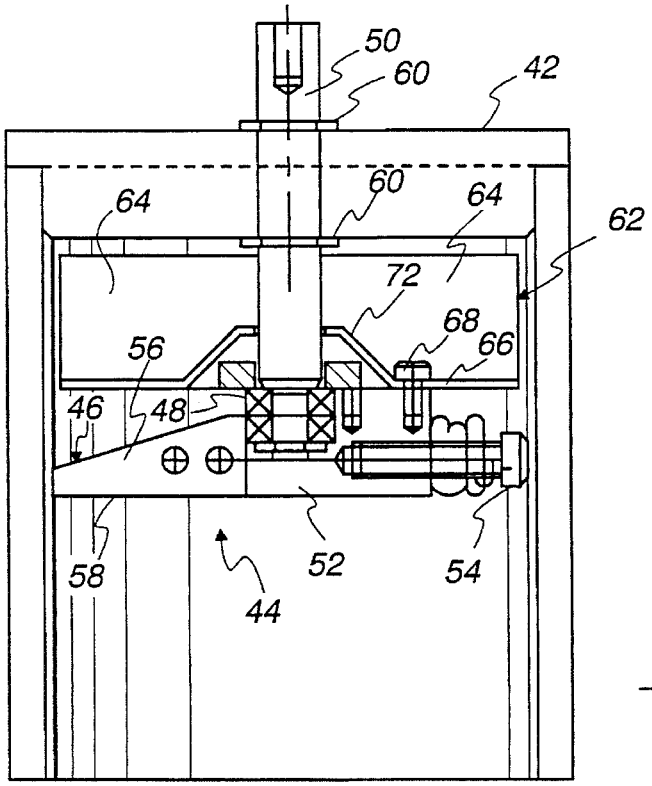
Fig. 4
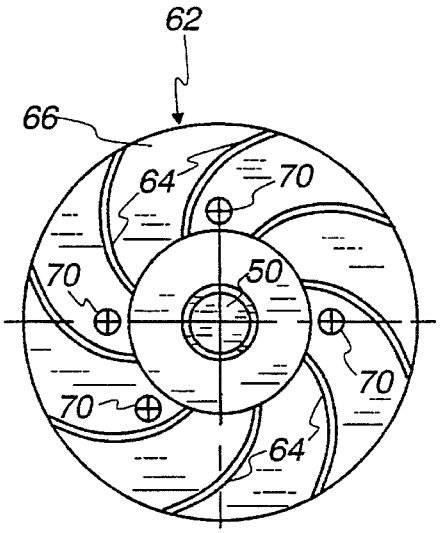
Fig. 5

ELECTRODE ARRANGEMENT FOR CREATING CORONA AND METHOD OF TREATING ELECTRICALLY-CONDUCTIVE SURFACES

BACKGROUND OF THE INVENTION

This invention relates to creation of electrical coronas, and in particular to an electrode arrangement and method of treating where electrically-conductive surfaces can be treated without arcing from the electrode to the surface.

As explained in U.S. Pat. No. 5,019,709, the disclosure of which is incorporated herein by reference, many materials, when molded, will not accept an adhesive, a coating, labels, inks or other printing vehicles unless the surface of the plastic has been chemically and/or physically altered. U.S. Pat. No. 5,019,709 discloses a particular electrode arrangement for creating a corona for treating surfaces for adherence of such vehicles. The electrode is activated by a high frequency electrical corona generator which is used to generate resonant frequencies on the order of 2 MHz and above. The BD-80 corona generator manufactured by Electro Technics Products, Inc., Chicago, Ill. USA, the assignee of the present application, is one such corona generator which functions quite adequately.

When a surface to be treated is electrically conductive, such as containing carbon or other conductive material, corona treating is difficult since the natural tendency is to extinguish the corona and, instead, create an arcing condition where the current arcs from the electrode directly to the item to be treated, without, therefore, actually treating that item. It is therefore desirable to create a corona treatment structure which can not only treat plastics, but also materials which are electrically-conductive.

SUMMARY OF THE INVENTION

The present invention provides an improved electrode arrangement for creating a corona over an area. The electrode arrangement is configured for attachment to a high frequency corona generator and has an electrode which is made of an electrically conductive material. The electrode includes a stem for attachment to the corona generator, a corona driving portion secured to the stem, and a corona emitting portion in electrical contact with the corona driving portion. The corona driving portion is configured in relation to the corona emitting portion such that corona from the electrode arrangement is emitted essentially from the corona emitting portion in a direction away from the corona driving portion. An electrically insulative shroud is provided for the electrode, the shroud including means for attachment of the shroud to the electrode and having a corona guide spaced from the electrode and extending essentially in the direction that corona is emitted, creating a corona cavity in the shroud. Means is provided for introducing a gas into the corona cavity.

In accordance with one form of the invention, the corona emitting portion of the electrode comprises a plurality of separate emitting elements, the emitting elements being stepped at an increasingly great distance from the corona driving portion from an outer emitting element to an inner emitting element.

In accordance with this form of the invention, the emitting elements may be generally concentric, and are stepped essentially linearly. The emitting elements comprise concentric rings in this form of the invention, and preferably the rings are circular. Each ring includes a taper to a corona emitting edge.

The emitting elements are preferably spaced, in accordance with this form of the invention, the spacing between adjacent emitting elements being essentially equal. If, on the other hand, the emitting elements comprise individual brush elements rather than concentric rings, spacing may be little, if at all.

The guide for the shroud is preferably cylindrical. The guide extends generally perpendicular to the corona driving portion of the electrode, creating the corona cavity in the shroud. The shroud is attached to the stem by an aperture in the shroud, the shroud being press fitted onto the stem.

The means for introducing gas into the cavity comprises a hole in the shroud. Preferably, a hose fitting or tube connector is provided in the hole, extending therefrom, so that a gas source can be directly applied to the shroud and the hole.

In accordance with a second form of the invention, the electrode arrangement includes a rotary portion including the corona driving portion and the corona emitting portion. In this form of the invention, the corona driving portion comprises a tapered blade and the corona emitting portion comprises a blade edge. The blade is rotatably secured to the stem. Preferably, means is also provided for counter balancing the blade for smooth rotation. A blade rotor is provided for rotating the blade. The blade rotor comprises a vaned disk mounted in proximity to the gas introduction means, the blade being secured to the disk. When the introduced gas impinges on the vanes, the disk is rotated.

In accordance with the method of the invention for treating an electrically conductive surface with a corona, the method comprises the steps of positioning an electrode adjacent the surface to be treated, and then enveloping the electrode and the surface with nitrogen. The electrode is then activated to treat the surface, with a source of high frequency, high voltage power being applied to the electrode for its activation. Preferably, the shroud is employed to contain the nitrogen for proper concentrations.

BRIEF DESCRIPTION OF THE DRAWINGS

The invention is described in great detail in the following description of examples embodying the best mode of the invention, taken in connection with the drawing figures, in which:

FIG. 3 is a top plan view, with portions omitted, of a second form of the invention, FIG. 4 is a cross sectional view taken generally along lines 4—4 of FIG. 3, and FIG. 5 is a plan view of the blade rotor according to the second form of the invention.

DESCRIPTION OF EXAMPLES EMBODYING THE BEST MODE OF THE INVENTION

Figure 1:
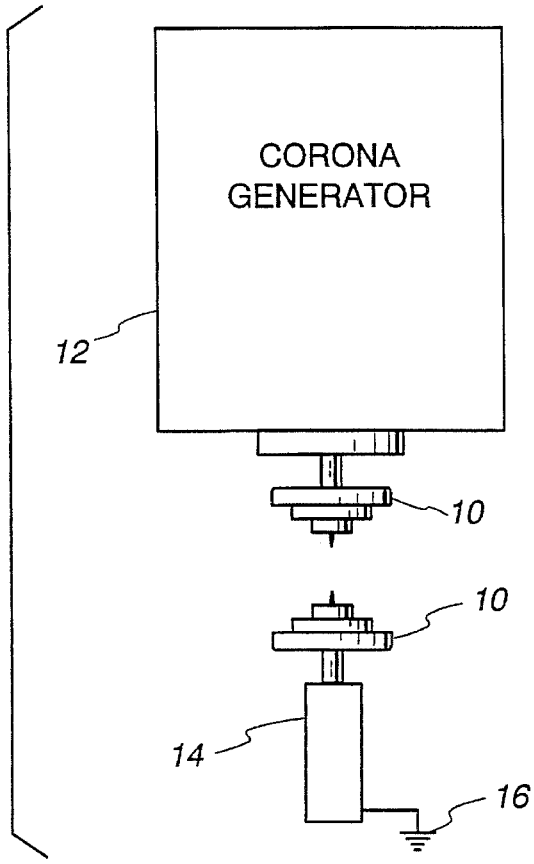
FIG. 1 is a schematic illustration of an electrode arrangement in conjunction with a corona generator and a resonator coil.

Illustrated in FIG. 1 is a pair of electrodes 10, one of which is installed in a corona generator 12 and the other of which is installed within a resonator coil 14. The corona generator 12 can be any readily available high voltage, high frequency corona generator, such as the BD-80 surface treater manufactured by Electro Technic Products, Inc., Chicago, Ill. and described above. The BD-80 surface treater optimally operates at 250 kv at a frequency of 2 MHz. Other suitable corona generators can be employed, and the invention is not limited to any particular type of corona generator nor any specific value of voltage or frequency generated by the corona generator, so long as a corona can be generated from the electrode 10. Also, the resonator coil is preferably as described in U.S. Pat. No. 4,924,092, the coils being composed of 225 turns of 30 magnetic wire which are wound at a rate of 30 turns per lineal inch. The resonator coil 14 is connected to a ground 16, preferably being the same ground as that for the corona generator 12. The two electrodes 10 as shown in FIG. 1 are for treatment over an area, and do not illustrate the shroud which is described in greater detail below.

Figure 2:
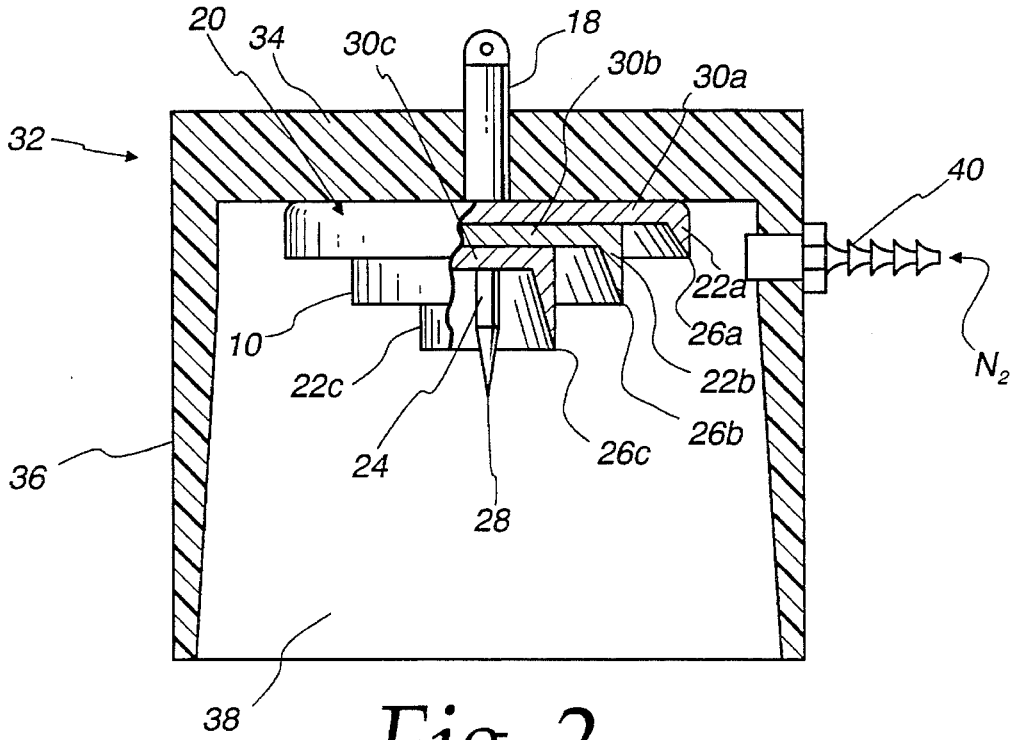
FIG. 2 is an elevational illustration of the invention, partially in cross section to show the internal structure of the arrangement.

As illustrated in FIG. 2, in a first form of the present invention the electrode 10 is composed of a stem 18 attached to a disk-like corona driving element 20. A series of ring-like corona emitting elements 22 extend from the corona driving element 20, a first corona emitting element 22*a* being formed at the outer circumference of the driving element 20, a second corona emitting element 22*b* spaced inwardly therefrom and a third corona emitting element 22*c* being spaced further inwardly therefrom. A center emitting element 24 is located at the precise center of the corona driving element 20, if desired. The center emitting element 24 can be eliminated and the outer elements 22 used alone.

Each of the corona emitting elements 22 is in the form of a ring, and tapers to a tip or edge 26*a–c* from which corona is emitted. Similarly, the center emitting element 24 tapers to a point 28 from which corona is emitted.

The emitting elements 22 and 24 are stepped from the outer emitting element 22*a* to the center emitting element 24. They are stepped essentially linearly. That is to say, if a line were drawn from the tip 26*a* to the point 28, the tips 26*b* and 26*c* would lie along that line. Also, spacing between the adjacent emitting elements 22, and between the emitting element 22*c* and the center emitting element 24, may be essentially equal. With the linear stepping of the elements and equal spacing, corona emitted from the electrode 10 is generally uniform, and therefore a surface to be treated is treated generally uniformly.

The corona driving element 20 may be a unitary portion of the electrode 10 or, as shown in FIG. 2, may be composed of disk-like portions 30*a*, 30*b* and 30*c* from which the corona emitting elements 22*a–*22*c* respectively extend. The electrode 10 can be assembled by forming a threaded post extending from the emitting element 24, through appropriate apertures in the disk portions 30*a–*30*c*, and engaging an internally threaded bore in the stem 18. Alternatively, the element 24 can be eliminated, and a screw, engaged within the stem 18, used for assembly of the electrode 10.

The electrode arrangement of the first form of invention as illustrated in FIG. 2 also includes an electrically insulative shroud 32. The shroud 32 includes a mounting portion 34 for attachment of the shroud to the stem 18 of the electrode 10. The shroud 32 also includes a corona guide 36 spaced from the electrode 10 and extending essentially perpendicular to the corona driving portion 20 of the electrode 10, therefore extending in essentially the direction that corona is emitted from the electrode 10.

The shroud 32 may be unitary, with the mounting portion 34 and the guide 36 therefore forming a corona cavity 38 within the shroud 32. The mounting portion 34 includes an aperture through which the stem 18 passes. Preferably the aperture is sized so that the mounting portion 34 is press fitted onto the stem 18 when the electrode arrangement of the invention is assembled.

Means is also provided for introducing gas into the corona cavity 38. That means comprises a barb fitting 40 installed within a hole in the side of the guide 36. The material of the shroud 32 is electrically insulative, as is the material of the barb fitting 40. The barb fitting 40 is formed to be attached to a hose, with the hose leading to a source of gas (not illustrated).

The gas used in connection with the generator of the invention preferably is nitrogen. When nitrogen is introduced into the corona cavity 38 through the barb fitting 40, and the electrode arrangement is placed near an electrically conductive surface to be treated, the presence of the nitrogen prevents arcing between the electrode 10 and the surface to be treated, even when the surface is grounded. Other gases have been tried, without adequate success in extinguishing arcing. Not all possible gasses have been tried, however, and one or more gases of other than nitrogen may function properly to prevent direct arcing between the electrode 10 and the conductive surface to be treated.

FIG. 1 illustrates use of two of the electrodes 10, each without a shroud 32. Obviously, either or both of the electrodes 10 could be enveloped in a shroud 32 for the treatment process. Also, as is evident in the incorporated patent, the resonant coil 14 (and its electrode 10) can be eliminated in various treating processes.

The electrode 10 is illustrated in the drawing figures as comprising a series of stepped rings. Rather than a series of concentric rings, however, the electrode 10 can comprise a brush with metal bristles, with the bristles at the center of the brush extending at a greater distance from the corona driving portion than the bristles at the edges of the brush. An area corona is also created using that type of electrode. Other types of electrodes might be usable, as well.

FIG. 3 illustrates a second form of the invention. In this form of the invention, the electrode arrangement is rotatable, utilizing introduced gas for rotation purposes.

This form of the invention includes a shroud 42, essentially the same as the shroud 32 of the first form of the invention. An electrode arrangement according to this form of the invention is generally depicted at 44. The electrode arrangement includes an electrode 46 rotatably and electrically connected to a stem 50. A housing 52 is also secured to the electrode 46, with an adjustable counter balance 54 being secured therein for proper balancing of the rotatable electrode 46 as it rotates.

The electrode 46 is in the form of a blade, and includes a corona driving portion 56 and a corona emitting portion or edge 58. Different configurations of the electrode 46 can also be employed. The electrode 46 is metallic, as is the stem 50, the stem 50 being configured for connection to a high voltage, high frequency source of electrical power, as described above.

The stem 50 is securely mounted in the shroud 42, either by force fitting or between a pair of snap rings 60. A blade rotor 62 is secured to the housing 52 about the stem 50. The blade rotor 62 comprises a vaned disk, having a series of vanes 64 upstanding from a circular disk 66. One or more bolts 68 extend through apertures 70 in the disk 66 for securing of the disk 66 to the housing 52. The disk 66 include a ramped inner portion 72 for proper fitting above the bearing 48.

As illustrated in this form of the invention, a gas inlet 74 extends in the shroud 42. The gas inlet 74 is mounted such that gas flowing there through impinges on the vanes 64, rotating the blade rotor 62, and therefore rotating the electrode 46 about the fixed stem 50. In this manner, the gas entering the shroud 42 not only serves as an arcing extinguisher as described above, but also serves as the motive force for rotating of the electrode 46. By adjusting the flow of gas through the inlet 74, the speed of rotation of the electrode 46 is controlled.

Various changes can be made to the invention without departing from the spirit thereof or scope of the following claims.

What is claimed is:

1. An electrode arrangement for creation of a corona over an area for surface treatment of an article with the corona, the electrode arrangement being configured for attachment to a high frequency corona generator and having an electrode made of an electrically conductive material, comprising a. a stem for attachment to the corona generator, b. a corona driving portion mounted on said stem, c. a corona emitting portion in electrical contact with said corona driving portion, d. said corona driving portion being configured in relation to said corona emitting portion such that corona from the electrode arrangement is emitted essentially from said corona emitting portion in a direction away from said corona driving portion, e. an electrically insulative shroud for said electrode, said shroud including means for attachment of said shroud to said electrode and having a corona guide spaced from said electrode and extending essentially in the direction that corona is emitted, creating a corona cavity in said shroud, and f. means for introducing a gas into said corona cavity, said gas enveloping said electrode and a surface of an article to be treated.

2. An electrode arrangement according to claim 1 in which said corona emitting portion comprises a plurality of separate emitting elements, said emitting elements being stepped at an increasingly greater distance from said corona driving portion from an outer emitting element to an inner emitting element,

3. An electrode arrangement according to claim 2 in which said emitting elements are generally concentric and are stepped essentially linearly.

4. An electrode arrangement according to claim 2 in which said emitting elements comprise concentric rings.

5. An electrode arrangement according to claim 4 in which each ring includes a taper to a corona emitting edge.

6. An electrode arrangement according to claim 2 in which said emitting elements are spaced, and spacing between adjacent emitting elements is essentially equal.

7. An electrode arrangement according to claim 1 in which said electrode arrangement includes a rotary portion including said corona driving portion and said corona emitting portion.

8. An electrode arrangement according to claim 7 in which corona driving portion comprises a tapered blade and said corona emitting portion comprises a blade edge, said blade being rotatably secured to said stem.

9. An electrode arrangement according to claim 8 including means for counterbalancing said blade.

10. An electrode arrangement according to claim 8 including a blade rotor.

11. An electrode arrangement according to claim 10 in which said blade rotor comprises a vaned disc mounted in proximity to said means for introducing gas, said blade being secured to said disc.

12. An electrode arrangement according to claim 1 in which said guide is cylindrical.

13. An electrode arrangement according to claim 12 in which said guide extends generally perpendicular to said corona driving portion.

14. An electrode arrangement according to claim 1 in which said means for attachment comprises an aperture in said shroud corresponding to said stem, said shroud being press fitted onto said stem.

15. An electrode arrangement according to claim 1 in which said means for introducing comprises a hole in said shroud.

16. An electrode arrangement according to claim 1 including a hose fitting extending from said hole.

17. An electrode arrangement according to claim 1 in which said guide is tapered.

18. A method of treating an electrically-conductive surface with a corona, comprising the steps of a. positioning an electrode adjacent the surface to be treated, b. enveloping the electrode and the surface with nitrogen, and c. activating the electrode to treat the surface by applying a source of high frequency, high voltage power to the electrode so that the electrode creates a corona enveloping the electrically-conductive surface.

19. A method according to claim 18 in which method step "b" includes containing the nitrogen in a shroud before method step "c".

20. A method according to claim 18 including the step of rotating said electrode during treating.

* * * * *